US008534341B2

(12) United States Patent
Coleman et al.

(10) Patent No.: US 8,534,341 B2
(45) Date of Patent: Sep. 17, 2013

(54) MOVABLE PARTITION SYSTEMS AND COMPONENTS THEREOF, METHODS IF INSTALLING MOVABLE PARTITION SYSTEMS, AND METHODS OF MOVING A MOVABLE PARTITION

(75) Inventors: W. Michael Coleman, Salt Lake City, UT (US); John G. Garrett, III, Magna, UT (US); Paul Saccomanno, West Valley, UT (US); Michael D. George, Kaysville, UT (US)

(73) Assignee: Won-Door Corporation, Salt Lake City, UT (US)

( * ) Notice: Subject to any disclaimer, the term of this patent is extended or adjusted under 35 U.S.C. 154(b) by 73 days.

(21) Appl. No.: 13/169,584

(22) Filed: Jun. 27, 2011

(65) Prior Publication Data

US 2012/0325414 A1 Dec. 27, 2012

(51) Int. Cl.
*E05F 15/00* (2006.01)

(52) U.S. Cl.
USPC ..... 160/84.02; 160/188

(58) Field of Classification Search
USPC ..... 160/84.02, 1, 7, 188, 189, 199, 331
See application file for complete search history.

(56) References Cited

U.S. PATENT DOCUMENTS 3,414,040 A * 12/1968 Harris ..... 160/188
3,425,160 A * 2/1969 Petterborg ..... 49/127
3,494,407 A * 2/1970 Bedrin et al. ..... 160/199
3,509,934 A * 5/1970 Smart ..... 160/84.08
3,577,679 A * 5/1971 Petterborg ..... 49/127
3,755,968 A * 9/1973 Williams ..... 49/489.1
3,783,930 A * 1/1974 Williams ..... 160/199
4,133,364 A * 1/1979 Smart ..... 160/199
4,538,661 A * 9/1985 Henry et al. ..... 160/35
4,924,929 A 5/1990 Johnson et al.
5,222,327 A * 6/1993 Fellows et al. ..... 49/139
5,638,639 A 6/1997 Goodman et al.
5,967,217 A * 10/1999 Wu ..... 160/331
6,098,695 A * 8/2000 Schwingle ..... 160/199
6,662,848 B2 12/2003 Goodman et al.
7,050,283 B2 5/2006 Field et al.
7,066,297 B2 6/2006 Goodman et al.
7,190,132 B2 3/2007 Goodman et al.
7,513,293 B2 4/2009 Goodman et al.
7,656,129 B2 2/2010 Banta et al.
7,737,860 B2 6/2010 Banta et al.
7,740,046 B2 6/2010 Goodman et al.
7,782,019 B2 8/2010 Banta et al.
7,845,384 B2 12/2010 Goodman et al.
7,845,385 B2 12/2010 Goodman et al.
7,845,386 B2 12/2010 Coleman et al.

(Continued)

*Primary Examiner* — David Purol
(74) *Attorney, Agent, or Firm* — TraskBritt

(57) ABSTRACT

Movable partition systems include a drive mechanism including a motor positioned at least partially on a side of a track opposite a movable partition. Automatically movable partition systems include a movable partition movable along a track and a motor configured to move the movable partition, the motor positioned on a side of the track opposite the movable partition. Methods of installing a movable partition system include coupling a movable partition to a track, positioning a drive mechanism at least partially on a side of the track opposite the movable partition, and coupling an elongated drive member to the movable partition. Methods of moving a movable partition along a track include actuating a drive mechanism positioned at least substantially in a header recess. Drive modules for a movable partition system and other methods of installing a movable partition system including attaching a motor to a section of track are also disclosed.

25 Claims, 7 Drawing Sheets

(56) References Cited

U.S. PATENT DOCUMENTS

| | | | |
|---|---|---|---|
| 7,854,248 | B2 | 12/2010 | Coleman et al. |
| 7,874,341 | B2 | 1/2011 | Coleman et al. |
| 7,886,804 | B2 | 2/2011 | Goodman et al. |
| 7,926,538 | B2 | 4/2011 | Coleman et al. |
| 7,931,067 | B2 | 4/2011 | Goodman et al. |
| 2008/0023152 | A1 | 1/2008 | Goodman et al. |
| 2008/0105387 | A1 | 5/2008 | Coleman et al. |
| 2008/0105389 | A1 | 5/2008 | Goodman et al. |
| 2008/0115896 | A1 | 5/2008 | Goodman |
| 2008/0169069 | A1 | 7/2008 | Coleman et al. |
| 2008/0197808 | A1 | 8/2008 | Banta et al. |
| 2008/0244991 | A1 | 10/2008 | Coleman et al. |
| 2009/0044918 | A1 | 2/2009 | Goodman et al. |
| 2009/0120595 | A1 | 5/2009 | Goodman et al. |
| 2009/0188633 | A1 | 7/2009 | Goodman et al. |
| 2010/0078134 | A1 | 4/2010 | Banta et al. |
| 2010/0102764 | A1 | 4/2010 | Banta et al. |
| 2010/0214709 | A1 | 8/2010 | Hall et al. |
| 2010/0299889 | A1 | 12/2010 | George |
| 2011/0000625 | A1 | 1/2011 | George |
| 2011/0005689 | A1 | 1/2011 | Coleman et al. |
| 2011/0024061 | A1 | 2/2011 | Bell et al. |
| 2011/0036016 | A1 | 2/2011 | Knight et al. |
| 2011/0036509 | A1 | 2/2011 | Goodman et al. |
| 2011/0036513 | A1 | 2/2011 | Banta et al. |
| 2011/0061820 | A1 | 3/2011 | Coleman et al. |
| 2011/0088322 | A1 | 4/2011 | Coleman et al. |
| 2011/0093095 | A1 | 4/2011 | Goodman et al. |

* cited by examiner

MOVABLE PARTITION SYSTEMS AND COMPONENTS THEREOF, METHODS IF INSTALLING MOVABLE PARTITION SYSTEMS, AND METHODS OF MOVING A MOVABLE PARTITION

TECHNICAL FIELD

Embodiments of the present invention relate to movable partition systems used for partitioning space within buildings, to components of such systems, and to methods of manufacturing, installing, and using such partition systems and components of such systems.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event such as the actuation of an associated alarm. For example, one or more accordion or similar folding-type partitions may be used as a security barrier, a fire barrier, or both a security barrier and a fire barrier wherein each partition is formed with a plurality of panels connected to one another in a hinged manner. The hinged connection of the panels enables the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other reason, the partition may be extended along an overhead track, which is often located above the movable partition in a header assembly, until the partition extends a desired distance across the room.

When deployed, a leading end of the movable partition, often defined by a component known as a lead post, complementarily engages another structure, such as a wall, a post, or a lead post of another door.

Automatic extension and retraction of the movable partition may be accomplished through the use of a motor located in a pocket formed in the wall of a building in which the movable partition is stored when in a retracted or folded state. The motor, which remains fixed in place within the pocket, may be used to drive extension and retraction of the movable partition with a belt or a chain. The motor fixed in the pocket is typically positioned at the back of the pocket behind the movable partition. Other components, such as a clutch, controller, charger, logic unit, position sensor, and other circuitry and hardware, may also be positioned in the pocket. In such a configuration, the motor and other components take up space in the pocket that could otherwise be used for stowing the movable partition. A motor for automatically extending and retracting a movable partition may also be mounted within the movable partition itself, such that the motor travels with the movable partition as the movable partition is extended and retracted using the motor.

DETAILED DESCRIPTION

Illustrations presented herein are not meant to be actual views of any particular movable partition system, or component of a movable partition system, but are merely idealized representations that are employed to describe embodiments of the present invention. Additionally, elements common between figures may retain the same numerical designation.

As used herein, the term "substantially" means to a degree that one skilled in the art would understand the given parameter, property, or condition is met with a small degree of variance, such as within acceptable manufacturing tolerances.

As used herein, relational terms, such as "first," "second," "over," "below," etc. describe elements when viewed from the perspectives shown in the figures and do not connote or depend on any specific preference, orientation, or order, except where the context clearly indicates otherwise.

As used herein, the terms "longitudinal" and "longitudinally" refer to a direction at least substantially parallel to an intended direction of movement of a movable partition upon extension or retraction of the movable partition along a track. In other words, an element of a partition system that extends "longitudinally" extends in a direction at least substantially parallel to a length of the track of the partition system.

Figure 1:
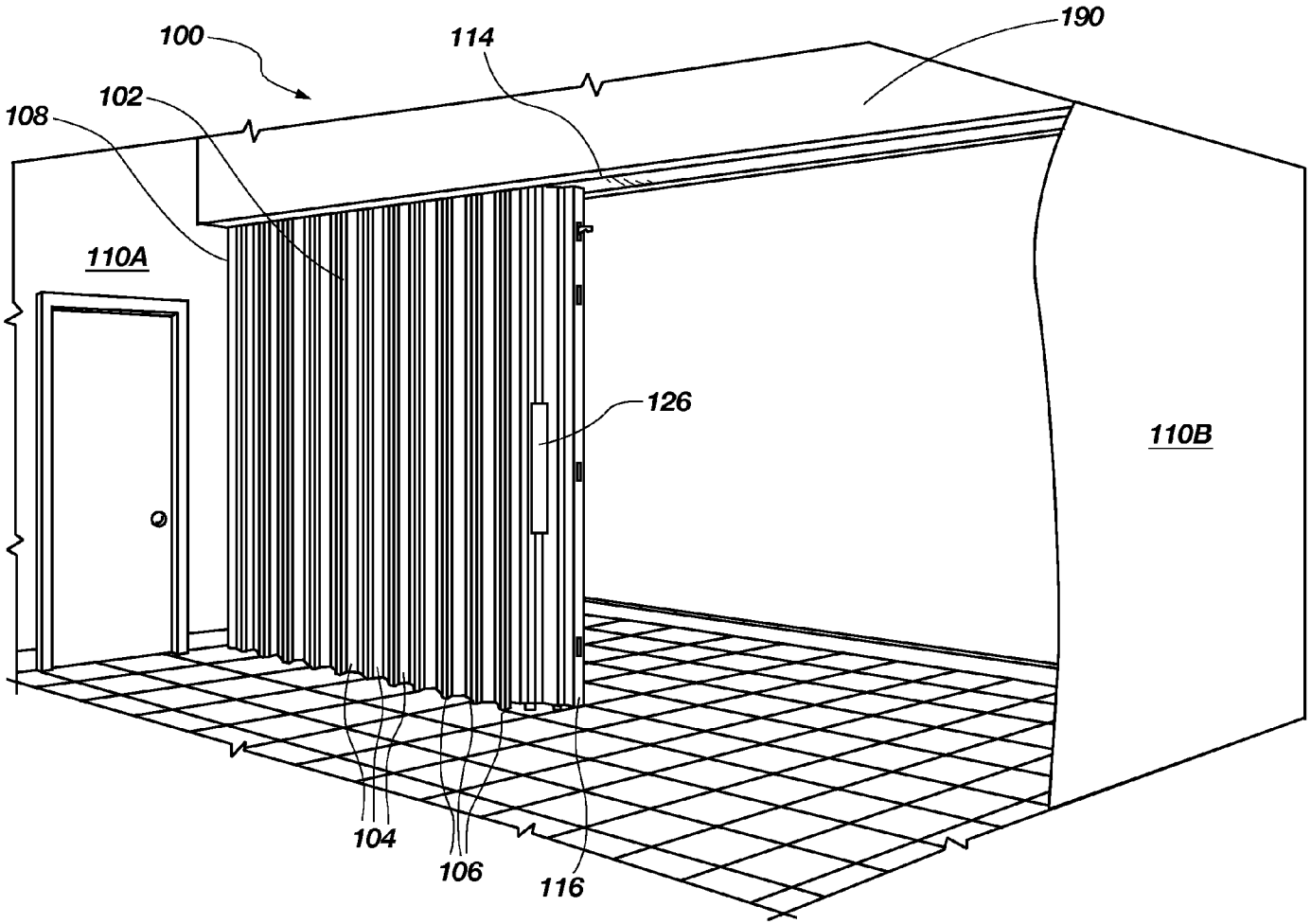
FIG. 1 is a perspective view of an embodiment of a movable partition system of the present disclosure installed within a building.

FIG. 1 illustrates an embodiment of a movable partition system 100. The movable partition system 100 is an automatic movable partition system, in that the movable partition system 100 includes a movable partition 102 that may be automatically extended, automatically retracted, or both automatically extended and automatically retracted. The movable partition 102 also may be manually extended and/or retracted if desired. The movable partition 102 may be used for partitioning space for any of a number of purposes, and be used, for example, as a sound barrier, as a fire barrier, and/or as a security barrier.

The movable partition 102 may include, for example, an accordion folding door, as shown in FIG. 1. The movable partition 102 may comprise a plurality of panels 104 that are connected to one another. For example, in some embodiments, the panels 104 may be connected together with hinges or other hinge-like members 106. In other embodiments, the panels 104 may be directly coupled to one another in such a manner as to allow the panels 104 to fold in a hinged manner. The hinged connection of the panels 104 enables the panels 104 to fold, and the movable partition 102 to collapse, as the movable partition 102 is retracted, which may enable the movable partition 102 to be compactly stored in a pocket 108 formed in a wall 110A of a building when in a retracted or folded state.

While embodiments illustrated and described with respect to the drawings of the disclosure are directed to a single accordion folding movable partition 102, other movable partitions may be used. For example, a two-door, or bi-part door, system may be utilized wherein two similarly configured doors extend across a space and join together to form an appropriate barrier. Also, the disclosure is applicable to movable partitions or barriers other than accordion folding doors, such as sliding doors.

Control of the movement of the movable partition 102 may be accomplished, in some embodiments, by the use of sensors, controls, and a drive mechanism, which will be described in more detail below (see FIGS. 5 and 6 and the accompanying description). The movable partition 102, when used as a fire door, for example, may include a switch or actuator 126, commonly referred to as "panic hardware." Actuation of the panic hardware 126 enables a person located on one side of the movable partition 102 to cause the door to be opened if it is closed, or to stop movement while it is closing, enabling egress through the barrier formed by the door as needed. Controls may also be located in other locations (e.g., remotely) and may be configured to extend or retract the movable partition 102 manually or automatically, such as when a fire alarm activates, at a certain time or date, or when other conditions are met.

The movable partition 102 may be suspended from (i.e., hang from) a track 114 along which the movable partition 102 moves as the movable partition 102 is expanded (i.e., closed) and retracted (i.e., opened). To deploy the movable partition 102 to an extended position, the movable partition 102 is moved along the track 114. A leading edge of the movable partition 102 may include a lead post 116 configured to engage with a door jamb or another post, which may be provided in a wall 110B of a building to which the movable partition 102 may extend in an extended state.

The movable partition system 100 may also include a header structure 190, which will be described in more detail below (see FIG. 4 and the accompanying description). The movable partition 102 may be suspended from and supported by the header structure 190. In other embodiments, the movable partition 102 may be supported by the floor or a track on the floor below the movable partition 102, and the header structure may simply serve as a guide for the movable partition 102. While the embodiment of the header structure 190 shown and described with reference to FIG. 1 protrudes into the space where the movable partition 102 is located, the header structure 190 may be partially or entirely located in an overhead structure in additional embodiments. For example, the header structure 190 may not protrude into the space where the movable partition 102 is located, but rather, may be located in an overhead structure such that the track 114 is mounted generally flush with the ceiling of the space.

Figure 2:
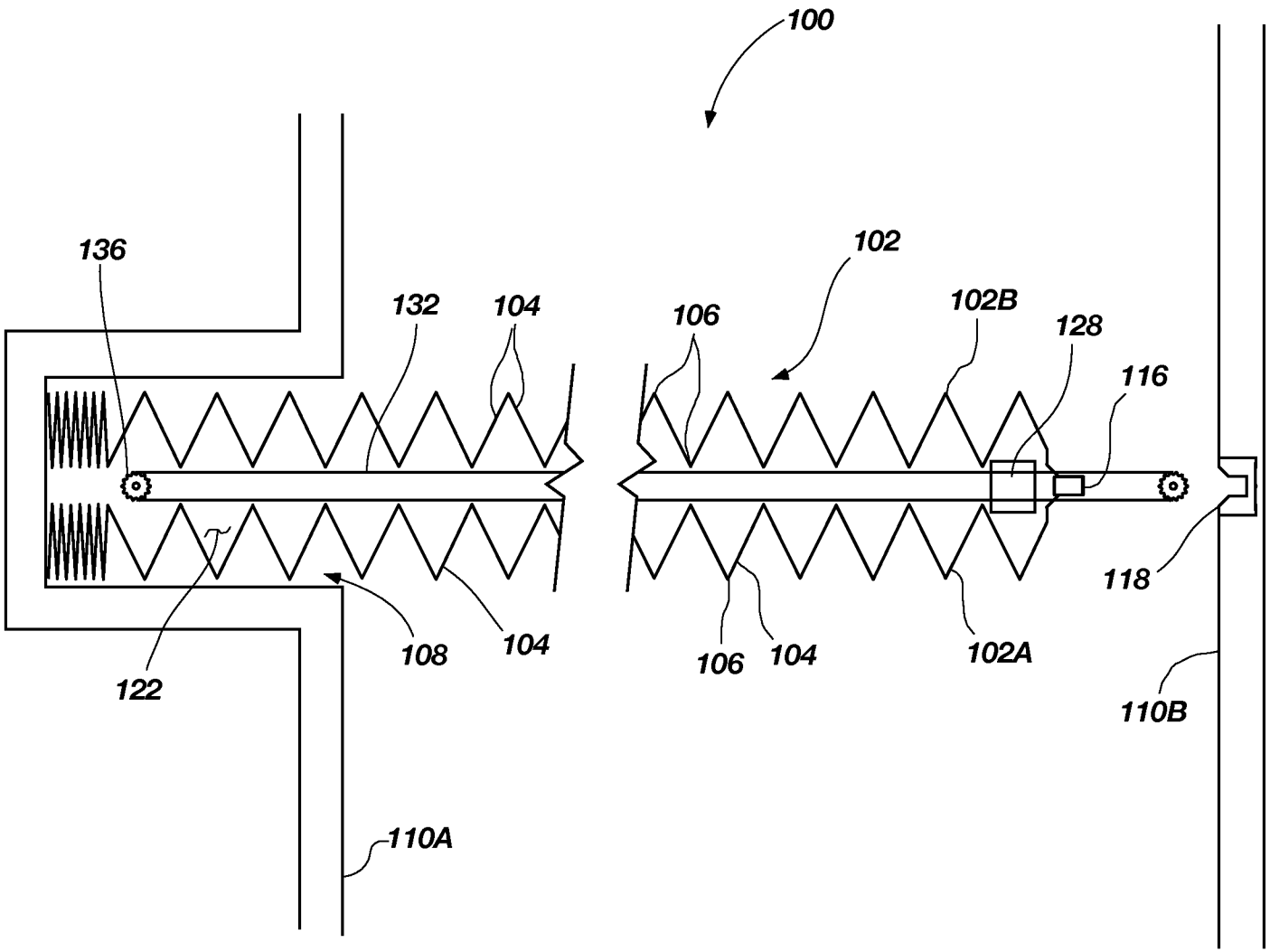
FIG. 2 is a simplified top view illustrating the movable partition and components of a drive system of the movable partition system of FIG. 1.

FIG. 2 illustrates a simplified top view of a movable partition system 100. A leading end of a movable partition 102, shown as a male lead post 116, matingly (i.e., complementarily) engages with a jamb or door post 118 that may be formed in another wall 110B of a building (or on a leading end of another complementary partition), when the movable partition 102 is in a deployed or an extended state. In some embodiments (not shown), the door post 118 may simply be flat or a flat portion of the wall 110B and the lead post 116 may be flat for abutting against the flat door post 118 or flat portion of the wall 110B.

A movable partition 102 may include a first sheet 102A of panels 104 and a second sheet 102B of panels 104 that is laterally spaced from the first sheet 102A of panels 104. Such a configuration may be used as a fire door wherein the first sheet 102A acts as a primary fire and smoke barrier, a space 122 between the first sheet 102A and the second sheet 102B acts as an insulator or a buffer zone, and the second sheet 102B acts as a secondary fire and smoke barrier. Such a configuration may also be useful in providing an acoustical barrier when the movable partition 102 is used to subdivide a larger space into multiple rooms.

The movable partition system 100 may include an elongated drive member 132 (e.g., a chain or a belt) coupled to the movable partition 102. For example, the elongated drive member 132 may be coupled to a drive trolley 128 so as to have a portion thereof fixed relative to the drive trolley 128. For example, a portion of the elongated drive member 132 may be fastened to the drive trolley 128 with one or more of a fastener (e.g., a screw, a bolt, or a rivet), a weld, an adhesive, and a mechanical interference. The drive trolley 128 may be an element of the movable partition 102. The drive trolley 128 may be coupled directly or indirectly to the movable partition 102 proximate a leading end of the movable partition 102, such as to the lead post 116 of the movable partition 102. The elongated drive member 132 may be engaged with a rotatable drive member 136. By way of example, the elongated drive member 132 may be a chain (e.g., a roller chain) and the rotatable drive member 136 may be a sprocket. The chain and the sprocket may have complementary features such that rotation of the sprocket pulls and/or pushes the chain in a desired direction. To extend the movable partition, the rotatable drive member 136 may be rotated and the portion of the elongated drive member 132 coupled to the drive trolley 128 may proceed along the track 114 (FIG. 1), thus driving the movable partition 102 across the space. To retract the movable partition 102, the rotatable drive member 136 may be rotated in the opposite direction, forcing the elongated drive member 132, the drive trolley 128, and, as a result, the movable partition 102, to proceed along the track 114 in the opposite direction. When the movable partition 102 is retracted, it may be stowed at least partially in a pocket 108 in a wall 110A.

Although FIG. 2 illustrates a rotatable drive member 136 located in the pocket 108 of the first wall 110A, the disclosure is not so limited. The rotatable drive member 136 may be positioned anywhere along the length of the track 114. For example, in some embodiments the rotatable drive member 136 may be positioned at an end of the track opposite the pocket 108, such as at or near the second wall 110B.

Figure 3:
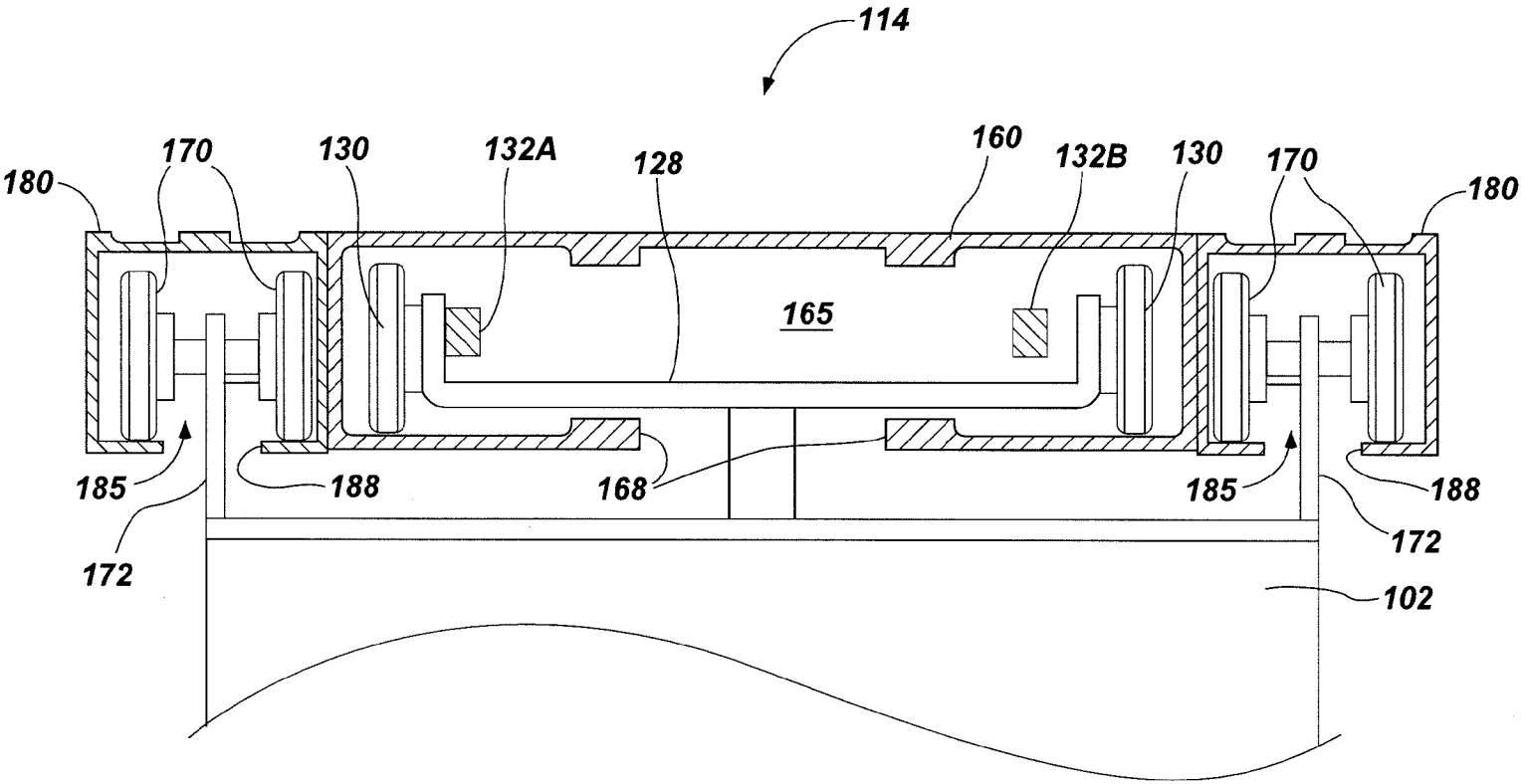
FIG. 3 is a partial cross-sectional view of a section of track of the movable partition system of FIG. 1.

FIG. 3 shows a cross-sectional view of the track 114. The track 114 is illustrated merely as an example of a type of track that may be used with movable partitions 102 of the present disclosure. Tracks having other configurations also may be employed in additional embodiments. A support system may include the track 114, which may include an elongated drive guide member 160 located generally centrally in the track 114, and two elongated roller guide members 180 disposed on opposite lateral sides of the elongated drive guide member 160. In some embodiments, the drive guide member 160 and roller guide members 180 may comprise separate bodies or structures that are attached to one another, or simply installed proximate one another. In other embodiments, the drive guide member 160 and roller guide members 180 may comprise different regions of a single, unitary body or structure.

The drive guide member 160 may comprise a generally hollow body having internal surfaces defining a drive channel 165 that extends longitudinally through the drive guide member 160 and is located generally centrally in the track 114. The drive guide member 160 may include a drive channel opening 168 on a side thereof. Components of the movable partition system 100 may be disposed at least partially within the drive channel 165, such as: a drive trolley 128 coupled to the movable partition 102 (e.g., to the lead post 116) through the drive channel opening 168; drive trolley rollers 130 (e.g., wheels) coupled to the drive trolley 128 and configured to be able to roll along and relative to the drive channel 165; an elongated drive member 132 (e.g., a chain or a belt); or any combination thereof. The elongated drive member 132 may be coupled (e.g., fastened, welded, or adhered) to the drive trolley 128 to extend or retract the movable partition 102 as the elongated drive member is driven through the drive channel 165 along the track 114. The elongated drive member 132 may loop through the drive channel 165 in some embodiments (see FIG. 2). Therefore, a first side of the elongated drive member 132A may be coupled to the drive trolley 128 while a second side of the elongated drive member 132B may not be coupled to the drive trolley 128. Thus, the drive trolley 128 and movable partition 102 may be driven along the track 114 depending on the movement of the first side of the elongated drive member 132A and independent of the movement of the second side of the elongated drive member 132B.

The roller guide members 180 may each comprise a hollow body having internal surfaces defining an internal roller channel 185 that extends longitudinally through each roller guide member 180. The roller guide members 180 may each include a roller channel opening 188 on a side thereof. The roller channels 185 may be partially defined by a bottom surface and innermost side surfaces internal to the roller guide members 180. Thus, the bottom and innermost side surfaces may define portions of the internal roller channels 185 of the track 114. Portions of the movable partition 102, such as, for example, the panels 104, may be suspended from (i.e., hang from) partition support members 172 that extend through the roller channel openings 188. The movable partition 102 may move along the track 114 by the rolling of partition support rollers 170 (e.g., wheels or bearings) rotatably coupled to the partition support members 172 and within the roller channels 185 in a direction at least substantially parallel to a direction of movement of the movable partition 102. In other words, the movable partition 102 may be coupled to the track 114 in a manner that enables the movable partition 102 to be moved (i.e., extended or retracted) along the track 114.

Figure 4:
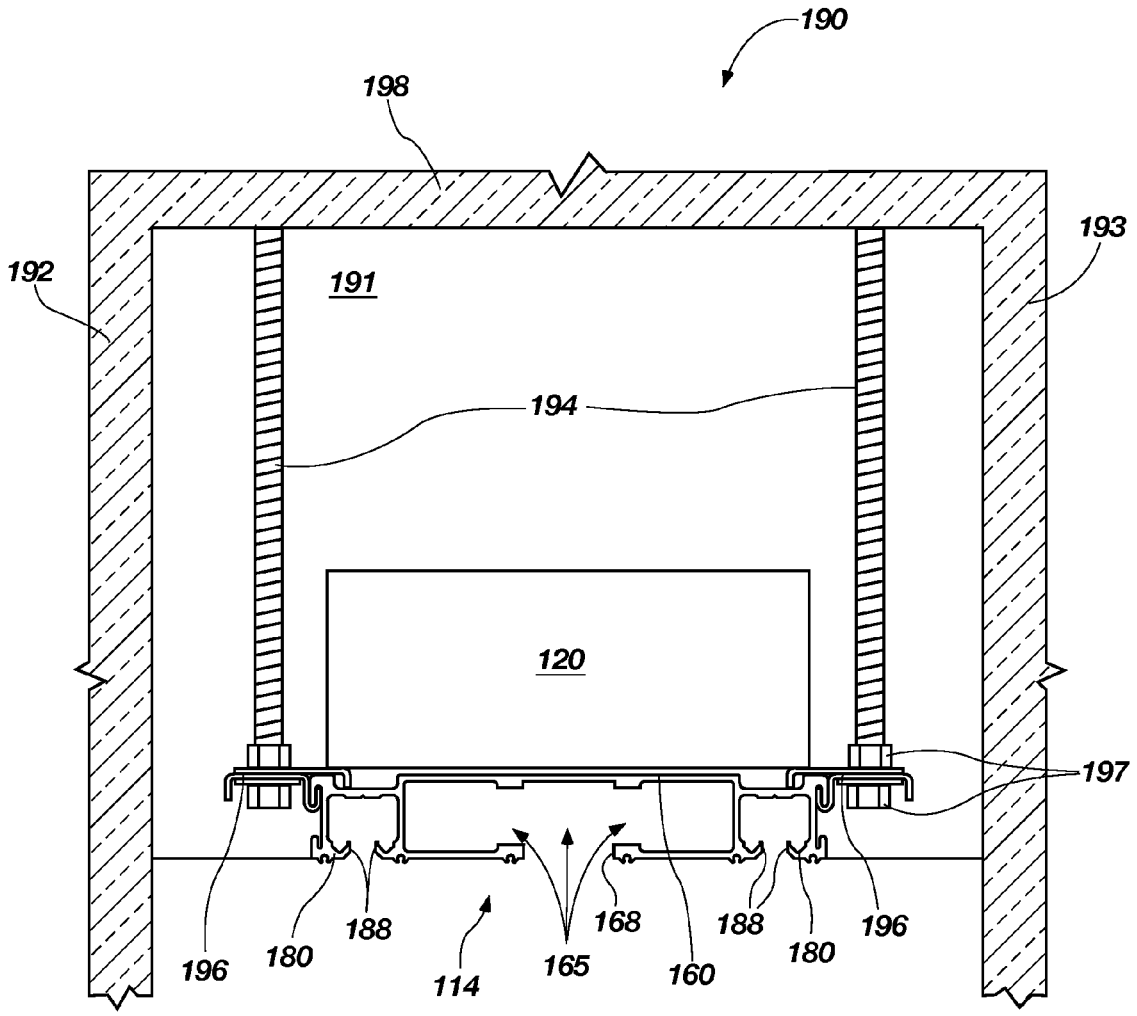
FIG. 4 is a partial cross-sectional view of a header structure and other components of the movable partition system of FIG. 1.

Referring to FIG. 4, the header structure 190 of the movable partition system 100 is shown in a partial cross-sectional view. In some embodiments, the header structure 190 for a movable partition 102 may include a track 114. The track 114 may include, for example, an elongated drive member 160 and an elongated roller guide member 180 on each lateral side of the elongated drive member 160, as described in more detail above. The track 114 may be attached to an overhead support member 198 by fastener elements such as rods 194. The overhead support member 198 may be, for example, a wood or metal beam, a truss structure, floor joists, etc. One end of each of the rods 194 may be attached to the overhead support member 198. Each rod 194 may comprise a threaded rod that extends through the overhead support member 198, and a nut may be threaded onto the end of the overhead support member 198 on a side thereof opposite the track 114 to retain the rod 194 in position relative to the overhead support member 198.

The track 114 may be coupled to (directly or indirectly) and suspended from the rods 194. As shown in FIG. 4, the track 114 may be indirectly coupled to the rods 194 using structural elements 196. The ends of the rods 194 opposite the overhead support member 198 may extend through a portion of the structural elements 196, and nuts 197 may be used to retain the structural elements 196 on the rods 194. The structural elements 196 may take the form of any of a number of well known and commercially available structural building and framing components. In some embodiments, the structural elements 196 may comprise elongated, at least substantially rectangular frame members. By the way of example and not limitation, the rods 194, the structural elements 196, and the nuts 197 may comprise components of a metal framing system commercially available from the UNISTRUT® Corporation of Wayne, Mich. The structural elements 196 may extend in sections or continuously along the length of the track 114 to support the track 114 and the movable partition 102 suspended therefrom.

In some embodiments, the rods 194 may be located at set distances along the track 114 to attach the structural elements 196 to the overhead support member 198. For example, the rods 194 may be spaced at set intervals along the track 114, each interval being spaced a set distance such as 18 inches (45.72 centimeters) apart. Further, in some embodiments, when the movable partition 102 is retracted (i.e., opened), the weight of the movable partition 102 will be concentrated in the area of the track 114 located above the retracted movable partition 102 (e.g., the section of the track 114 located in the pocket 108). Therefore, the rods 194 may be spaced at shorter intervals, such as 12 inches (30.48 centimeters), in the area where the movable partition 102 is stored in a retracted state. It is noted that while the structural elements 196 of FIG. 4 are shown suspended from the overhead support member 198 by the rods 194, the structural elements 196 may be attached, suspended, or spaced from the overhead support member 198 by any suitable manner including, but not limited to, attaching the structural elements 196 directly to the overhead support member 198.

With continued reference to FIG. 4, a drive mechanism 120 may be located at least partially within a header recess 191 in the header structure 190. Internal surfaces of a first wall 192, a second wall 193, and an overhead support member 198 of the header structure 190 may define the header recess 191. In some embodiments where the movable partition system 100 is implemented as a fire barrier, the walls 192, 193 may be formed from a fire-resistant material. In some embodiments, such as where the track 114 is mounted generally flush with a ceiling, the walls 192, 193 may be omitted. While the embodiment shown in FIG. 4 illustrates a drive mechanism 120 located at least partially within the header recess 191 and directly above the track 114, the current invention is not so limited. The drive mechanism 120 may not be located directly above the track 114, but rather may be located in any suitable location or may be mounted directly to the overhead support structure 198.

Figure 5:
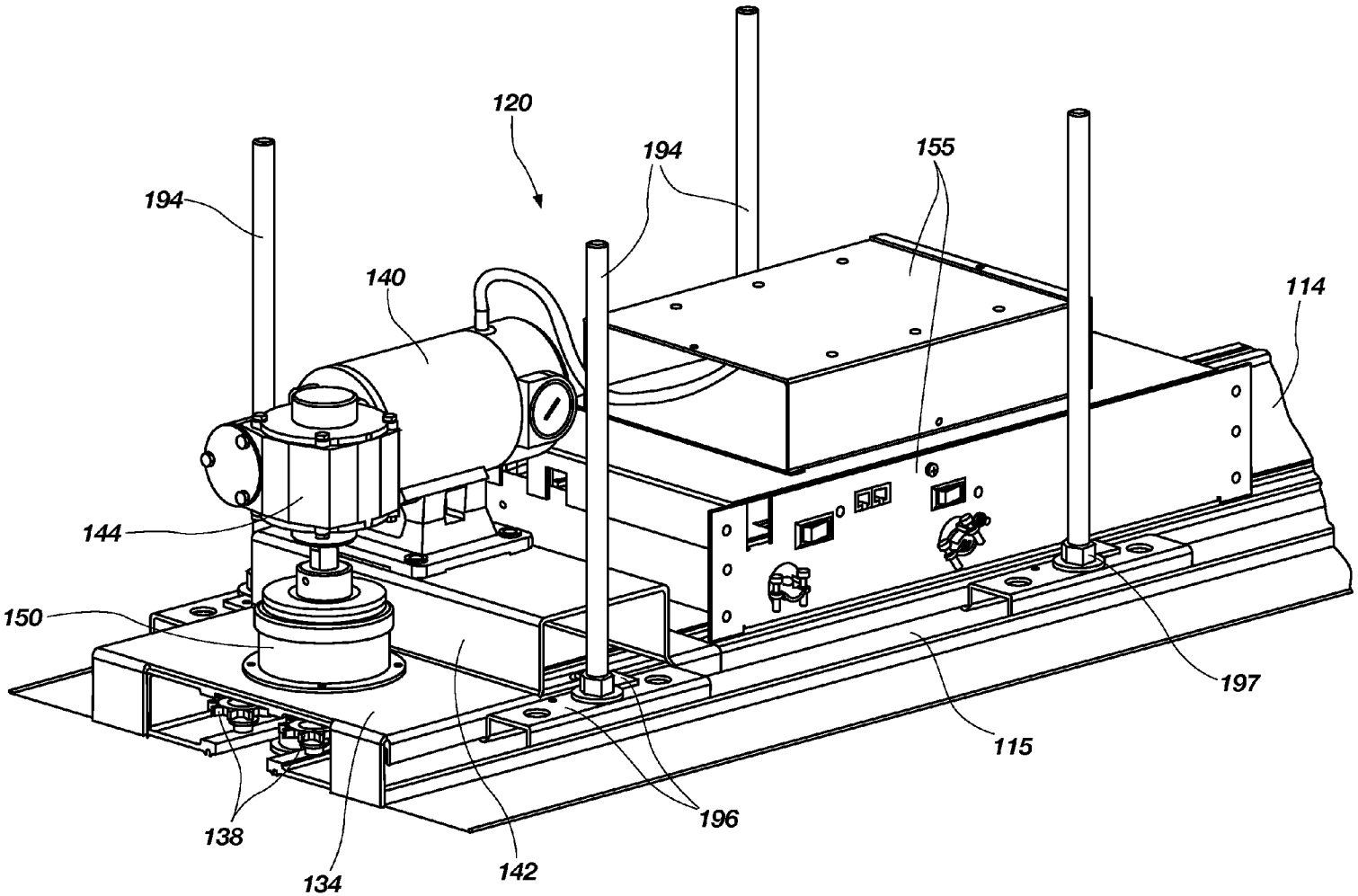
FIG. 5 is a partially cut-away perspective view of a drive mechanism of the movable partition system of FIG. 1 mounted to and carried by a section of track on a side thereof opposite the movable partition.

By way of example and with reference to FIGS. 4 and 5, the drive mechanism 120 may be positioned at least partially within the header recess 191 and coupled to a section of the track 114. By way of example and not limitation, the drive mechanism 120 may be coupled to a detachable section 115 of the track 114. The detachable section 115 of the track 114 may be a so-called "repair section" of the track 114. The detachable section 115 may be a portion of the track 114 that may be detached from the movable partition system 100 without fully disassembling the movable partition system 100. As used herein, the term "detachable" means and includes able to be at least partially removed or detached by: loosening or removing bolts, nuts, clips, or other retaining members; or sliding or otherwise moving the detachable element out of an operating position. As used herein, the phrase "detachable section of track" refers to a section of track that is intended and configured to be detached or removed from a movable partition more readily than other sections of track. For example, in some embodiments, the detachable section 115 may be configured to be detached or removed from the movable partition system 100 more easily than other sections of the track 114. The detachable section 115 of the track 114 may be configured to be detached to access space above the track 114, to remove the movable partition 102 from the track 114, to install the movable partition 102 in the track 114, to perform maintenance or repairs on the movable partition system 100, or for other reasons. The detachable section 115 may be any length of track, such as, for example, about 30 inches (76.2 cm) of track. The drive mechanism 120 is illustrated generically in FIG. 4 as a box; however, the drive mechanism 120 includes one or more components and features that will be described in more detail below with reference to FIG. 5 and may take any number of forms and configurations.

The detachable section 115 of the track 114 may be positioned at any location along the track 114. By way of example, the detachable section 115 may be a portion of the track 114 located within the pocket 108 (see FIG. 2) of the first wall 110A. In some embodiments, the detachable section 115 may be a portion of the track 114 located at or near the second wall 110B. In some embodiments, the detachable section 115 may be a portion of the track 114 located at or near the middle of the length of the track 114. In other words, the disclosure is not limited to the particular location of the detachable section 115 shown in the figures.

Referring now to FIG. 5, an automatic drive mechanism 120 may be configured to automatically open, automatically close, or to both automatically open and automatically close the movable partition 102 upon actuation thereof. The drive mechanism 120 may also be configured to allow for manual movement of the movable partition 102 along the track 114.

As illustrated in FIG. 5, the drive mechanism 120 may be positioned at least partially over a section of the track 114. In other words, the drive mechanism may be positioned vertically above the section of the track 114 when installed in a building with a space to be partitioned. In some embodiments, the drive mechanism 120 may be positioned at least substantially fully over the detachable section 115 of the track 114. The drive mechanism 120 may be attached directly or indirectly to the detachable section 115 of the track 114. Alternatively or additionally, the drive mechanism 120 may be attached to one or more of the rods 194, the walls 192, 193, and the overhead support member 198 over the detachable section 115. In other words, the disclosure is not limited to positioning the drive mechanism 120 in the particular location and configuration shown in the figures.

In some embodiments, detachment of the detachable section 115 of the track 114 may be accomplished by loosening or removing nuts 197 from the rods 194 and removing the structural elements 196 that support the detachable section 115. Positioning the drive mechanism 120 over the detachable section 115 of the track 114 may be advantageous when compared to previously known configurations for several reasons. By way of example, positioning the drive mechanism 120 at least partially over the detachable section 115 of the track 114 may: improve the ease and cost of installation and maintenance; more efficiently use space in the pocket by reducing or eliminating longitudinal (i.e., in the direction the track 114 extends) space taken up by the drive mechanism 120; reduce the amount of wiring required in the drive mechanism 120 by locating the components thereof close together; reduce the overall size of the drive mechanism 120; reduce the amount and cost of packaging for the drive mechanism 120; and/or provide for easier handling of the drive mechanism 120. Other advantages may be apparent to one skilled in the art.

Figure 6:
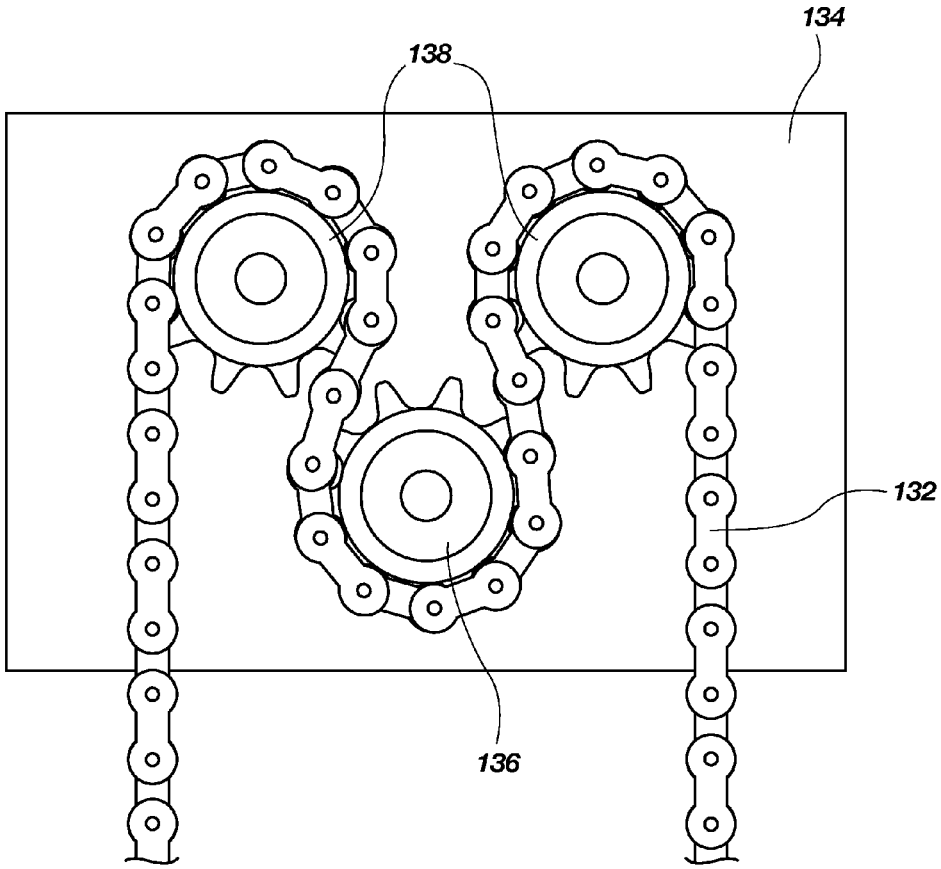
FIG. 6 is a top view of components of a drive system of the movable partition system of FIG. 1.

The drive mechanism 120 may include a motor 140 that directly or indirectly drives rotation of a rotatable drive member 136 (see FIG. 6). Optionally, a gearbox 144 may be coupled to a drive shaft of the motor 140 and a clutch mechanism 150 may be coupled to a drive member (e.g., a drive shaft, a hub, etc.) of the gearbox 144. The gearbox 144 may be included in the drive mechanism 120 to transfer rotation of the drive member of the motor 140 from one direction to another direction for driving the rotatable drive member 136. For example, the motor 140 may be positioned and oriented such that the drive shaft of the motor 140 is rotatable about a rotational axis parallel to the length of the track 114. The gearbox 144 may be used to transfer the rotation of the drive member of the motor 140 into a different direction for driving the rotatable drive member 136 about a differently oriented axis, such as about an axis that is perpendicular to the length of the track 114. The gearbox 144 may also provide a mechanical advantage to the drive mechanism 120. The clutch mechanism 150 may be coupled to the rotatable drive member 136 (see FIG. 6) to drive the rotation of the rotatable drive member 136 and to enable disengagement of the rotatable drive member 136 from the motor 140 (such as for manual movement of the movable partition 102 along the track 114). The rotation of the rotatable drive member 136 causes the elongated drive member 132 engaged therewith to extend or retract the movable partition 102 along the track 114 of the movable partition system 100.

The motor 140 may be mounted to a motor support member 142 (e.g., a bracket), which may be attached to the detachable section 115 of the track 114. Alternatively, the motor 140 may be mounted directly to the detachable section 115 of the track 114. In some embodiments, the motor 140 may be positioned and configured to drive the elongated drive member 132 without the use of one or more of the gearbox 144 and the clutch mechanism 150. For example, the rotatable drive member 136 may be fixedly mounted to the drive member of the motor 140. In other words, the rotatable drive member 136 may not be disengaged from the motor 140 in any manner other than disassembly.

By way of another example, the drive mechanism 120 may be configured to include a motor 140 and a clutch mechanism 150 without a gearbox 144. The motor 140 may drive rotation of a component (e.g., a shaft) of the clutch mechanism 150, which may be fixedly attached to the rotatable drive member 136. Alternatively, and by way of another example, the drive mechanism 120 may be configured to include a motor 140 and a gearbox 144 without a clutch mechanism 150. The motor 140 may drive rotation of a component (e.g., a shaft) of the gearbox 144, which may be fixedly attached to the rotatable drive member 136. In other words, the disclosure is not limited to the particular components and configuration of the drive mechanism 120 shown in FIG. 5; reorganization of the components and modification of the drive mechanism 120 and its components may be within the scope of the disclosure.

The motor 140 may be an electric motor. In one embodiment, the motor 140 may include a brushed direct current (DC) motor and the gearbox 144 may include a planetary gearbox, both available from Bodine Electric Company, Northfield, IL. Of course, it will be appreciated by those of ordinary skill in the art that other components may be used for the motor 140 and gearbox 144 in practicing the described embodiment. Additionally, other mechanisms may be used for driving the movable partition 102 along the track 114.

With continued reference to FIG. 5, the drive mechanism 120 may include electronic components 155 positioned over a detachable section 115 of the track 114. By way of example and not limitation, the electronic components 155 may include one or more of a controller, a logic unit, a position sensor, and a charger. The electronic components 155 may serve any number of functions, including one or more of the following: providing electricity to and control of the motor 140; controlling the engagement or disengagement of the clutch mechanism 150; sensing and recording the position of the movable partition 102 along the track 114; activating or responding to alarms; and other functions as may be apparent to one skilled in the art.

Referring to FIG. 6 in conjunction with FIGS. 3 and 5, a support structure 134 may be included in the drive mechanism 120. The support structure 134 may be a portion of the detachable section 115 of the track 114 or it may be a separate structure positioned proximate the detachable section 115. In some embodiments, the support structure 134 and the motor support member 142 may be parts of a unitary body configured to be attached to the detachable section 115 of the track 114 and configured to support the motor 140 and the clutch mechanism 150 (see FIG. 5). A rotatable drive member 136 and one or more idlers 138 may be attached to the support structure 134 so as to be able to be rotated relative to the support structure 134. The rotatable drive member 136 (e.g., sprocket) may be engaged with the elongated drive member 132. Rotation of the rotatable drive member 136 causes the movable partition 102 to be pulled or pushed along the track 114 through movement of the elongated drive member 132. The rotatable drive member 136 may be driven, directly or indirectly, by the motor 140, as described in more detail above.

The drive mechanism 120 may optionally include one or more idlers 138 (e.g., sprockets) with which the elongated drive member 132 is also engaged. The idlers 138 may be used to align the elongated drive member 132 with the drive trolley 128, to ensure proper tension of the elongated drive member 132, and/or to redirect the movement of the elongated drive member 132. By way of example and as shown in FIG. 6, the elongated drive member 132 may extend from within the drive channel 165 of the track 114, loop partially around and be engaged with a first idler 138, loop partially around and be engaged with the rotatable drive member 136, loop partially around and be engaged with a second idler 138, and extend back into the drive channel 165 of the track 114. Optionally, the drive mechanism 120 may omit one or more of the idlers 138. For example, the elongated drive member 132 may extend from within the drive channel 165 of the track 114 and directly loop partially around and be engaged with the rotatable drive member 136. The disclosure is not limited to the particular configuration of the rotatable drive member 136, the idlers 138, and the elongated drive member 132; rather, the relative positions and interplay of these components may be modified due to, for example, space constraints, availability and cost of materials, type of movable partition, and other reasons that may be apparent to one skilled in the art.

The disclosure also includes methods of installing a drive mechanism 120 of a movable partition system 100. In some embodiments, a method of installing a drive mechanism 120 of a movable partition system 100 may include positioning components of a drive mechanism 120 at least partially over a detachable section 115 of a track 114 (i.e., on a side of the detachable section 115 opposite a movable partition 102) (see FIG. 5). By way of example and not limitation, the method may include positioning one or more of a motor 140, electronic components 155, a gearbox 144, and a clutch mechanism 150 at least partially over the detachable section 115 of the track 114. Each of these components of the drive mechanism 120 is described in more detail hereinabove. In some embodiments, one or more of these components of the drive mechanism 120 may be positioned at least substantially fully over the detachable section 115 of the track 114. Positioning the drive mechanism 120 over the detachable section 115 of the track 114 may include fixedly attaching the components thereof, directly or indirectly, to the detachable section 115 using, for example, a fastener, bolt, screw, rivet, weld, adhesive, clip, etc.

In some embodiments, the method may include attaching the one or more components of the drive mechanism 120 to the detachable section 115 of the track 114 before installing the detachable section 115 in the movable partition system 100 (i.e., in the header structure 190 of the movable partition system 100) (see FIG. 5). For example, the method may include attaching each of a motor 140 and electronic components 155 to the detachable section 115 of the track 114 and subsequently installing the detachable section 115 with the motor 140 and electronic components 155 attached thereto into a header structure 190 of a movable partition system 100.

In some embodiments, the method may include attaching the one or more components of the drive mechanism 120 in a header recess 191 (see FIG. 4) of a movable partition system 100 at least partially over a detachable section 115 of a track 114. For example, the method may include attaching one or more of a motor 140, a gearbox 144, a clutch mechanism 150, and electronic components 155 to one or more of an overhead support member 198, a first wall 192, a second wall 193, and one or more rods 194. The attaching of the one or more components of the drive mechanism 120 in the header cavity 191 may, in some embodiments, occur before installing the detachable section 115 of the track 114 in the movable partition system 100.

The disclosure also includes methods of moving a movable partition 102 along a track 114. Such methods may include actuating a drive mechanism 120 described hereinabove positioned over a detachable section 115 of the track 114 (such as in a header recess 191). The method may also include rotating a rotatable drive member 136 with the drive mechanism 120. Rotating the rotatable drive member 136 may cause movement of the movable partition 102 along the track 114 by way of an elongated drive member 132 engaged with the rotatable drive member 136 and fixedly coupled to the movable partition 102. Some embodiments of the method of moving the movable partition 102 may also include other acts, as may be appreciated by one skilled in the art considering the disclosure.

Figure 7:
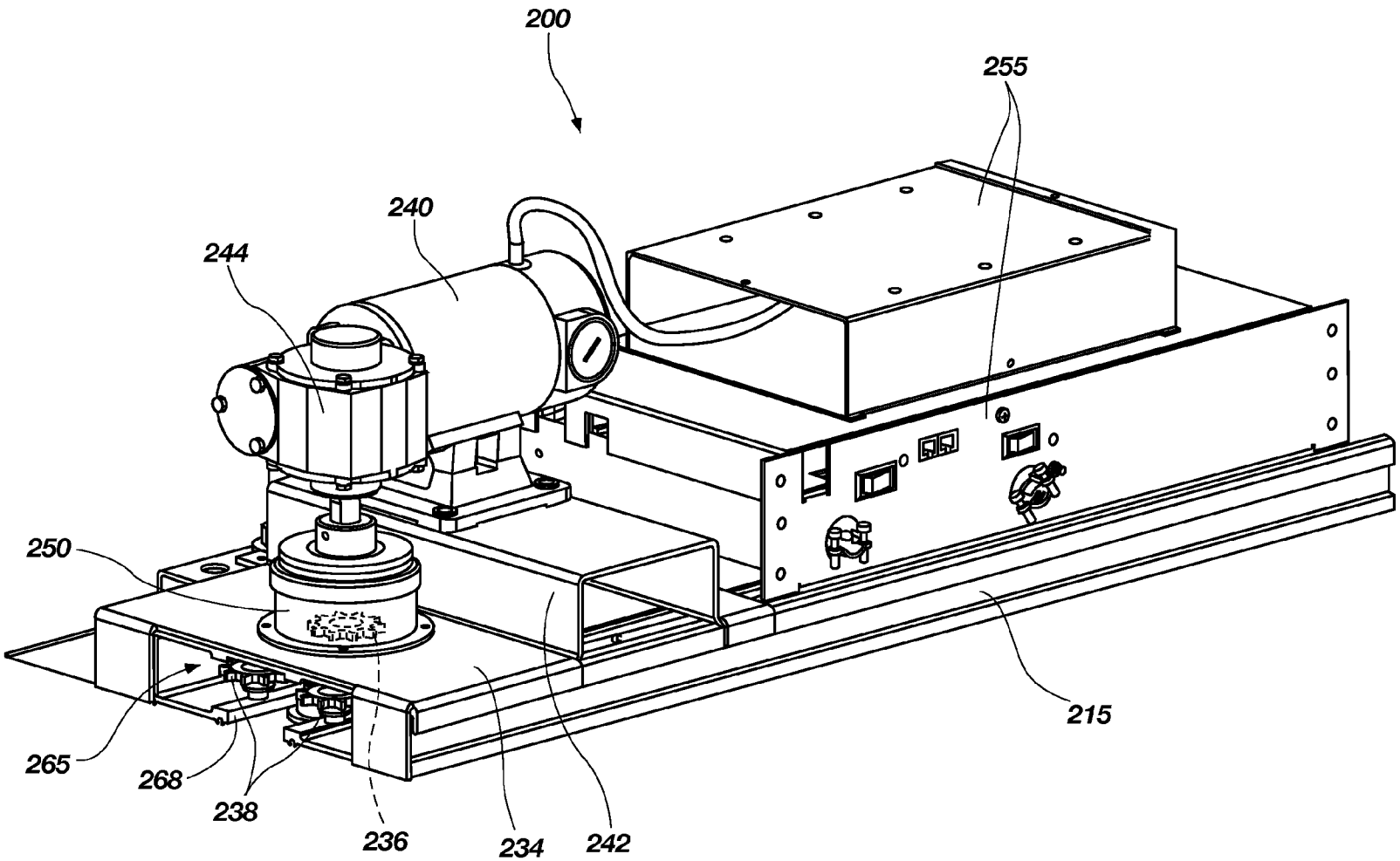
FIG. 7 is a perspective view of an embodiment of a drive module for a movable partition system of the present disclosure, which includes a motor mounted to a section of track.

Referring now to FIG. 7, in some embodiments, the disclosure includes a drive module 200 for a movable partition system 100. The drive module 200 may be a unit including at least a portion of a drive system configured to drive movement of a movable partition 102 across a space. For example, the drive module 200 may include a section of track 215 intended to be installed in a building proximate another section of track 114. The section of track 215 may be configured to support or guide at least a portion of a movable partition 102. At least one channel 265 defined by at least one interior surface of the section of track 215 may longitudinally extend through the section of track 215. The channel 265 may be configured to receive and support at least one roller therein. The section of track 215 may include a longitudinally extending opening 268 to the channel 265, the longitudinally extending opening 268 defined by another surface of the section of track 215. The longitudinally extending opening 268 to the channel 265 may be located on a first side of the section of track 215 (e.g., the bottom of the section of track 215 as shown in FIG. 7). The longitudinally extending opening 268 may be included in the section of track 215 to enable a member (such as, for example, a portion of the drive trolley 128 of FIG. 3 or the partition support member 172 of FIG. 3) to extend therethrough for support or guidance of the movable partition 102 to be coupled to and movable along the section of track 215.

The drive module 200 may include a motor 240 coupled to the section of track 215 on a second side thereof opposite the first side (e.g., the top of the section of track 215 as shown in FIG. 7). By way of example, the motor 240 may be attached directly to the section of track 215. By way of another example, the motor 240 may be attached to a motor support member 242, the motor support member 242 coupled directly to the section of track 215. The motor 240 may, in some embodiments, be positioned such that a drive member (e.g., a drive shaft, a hub, etc.) of the motor 240 rotates about a rotational axis parallel to a longitudinal length of the section of track 215, as shown in FIG. 7. In other embodiments, the motor 240 may be positioned such that the drive member of the motor 240 rotates around an axis perpendicular to a longitudinal length of the section of track 215.

The drive module 200 for the movable partition system 100 may include a gearbox 244 coupled to the drive member of the motor 240, essentially as described hereinabove with reference to the gearbox 144. The drive module 200 may include a clutch mechanism 250 coupled to a drive member (e.g., a drive shaft, a hub, etc.) of the gearbox 244, or, if the gearbox 244 is absent, coupled to a drive member of the motor 240. The clutch mechanism 250 of the drive module 200 may serve essentially the same functions and be configured in essentially the same way as the clutch mechanism 150 of the drive mechanism 120 described hereinabove.

The drive module 200 may, optionally, include at least one electronic component 255 also coupled to the section of track 215 on the second side thereof (i.e., opposite the longitudinally extending opening 268 to the section of track 215). By way of example, the at least one electronic component 255 may include one or more of a controller, a logic unit, a position sensor, and a charger. The at least one electronic component 255 may be configured to serve any number of functions, such as, for example: provide electricity to and control of the motor 240; control the engagement or disengagement of the clutch mechanism 250; sense and record the position of the movable partition 102 along the track 114; activate or respond to alarms; and other functions as may be apparent to one skilled in the art.

The drive member 200 may further include a rotatable drive member 236 and, optionally, one or more idlers 238. Each of the rotatable drive member 236 and the one or more idlers 238 may be coupled to a support structure 234 such that each is able to rotate relative to the support structure 234. The support structure 234 may be a portion of the section of track 215 or the support structure 234 may be an element distinct from the section of track 215 and configured to be coupled with the section of track 215. The support structure 234 may be a unit distinct from the motor support member 242 or the support structure 234 and the motor support member 242 may be formed as a single unit.

The drive module 200 of the present disclosure is not limited to the particular configuration illustrated in FIG. 7. In some embodiments, the drive module 200 may omit one or more of the components illustrated in FIG. 7. For example, the drive module 200 may include a motor 240 and a rotatable drive member 236 coupled to a support structure 234 without one or more of the section of track 215, the clutch mechanism 250, the gearbox 244, and the at least one electronic component 255. In some embodiments, the section of track 215 may be omitted and the drive module 200 may comprise a support structure 234 configured to be coupled to a section of track 215 of a movable partition system 100. The drive module 200 may further include one or more of a motor 240, a gearbox 244, a clutch mechanism 250, a rotatable drive member 236, one or more idlers 238, and at least one electronic component 255 coupled to (e.g., attached to) the support structure 234.

The disclosure also includes methods of installing a movable partition system 100 including at least partially assembling a drive module 200. At least partially assembling the drive module 200 may include attaching a motor 240 to a section of track 215 on a side thereof opposite a longitudinally extending opening 268 of the track. The motor 240 may be attached in an orientation such that a drive member (e.g., a drive shaft) thereof may be configured to rotate about a rotational axis at least substantially parallel to a longitudinal length of the section of track 215. At least partially assembling the drive module 200 may also include attaching at least one electronic component 255 to the same side of the section of track 215 as the motor 240 and coupling at least one of a gearbox 244 and a clutch mechanism 250 to the motor 240 to enable the motor 240 to drive the at least one of the gearbox 244 and the clutch mechanism 250.

At least partially assembling the drive module 200 may include at least partially assembling the drive module 200 in a first location remote from a second location (e.g., a building) where the movable partition system 100 is to be installed. The first location may be, by way of example, a manufacturing facility or distribution center. The at least partially assembled drive module 200 may then be transported (e.g., shipped, sent, mailed, etc.) to the second location.

The method of installing the movable partition system 100 may further include installing the at least partially assembled drive module 200 in a building with a space to be partitioned. The at least partially assembled drive module 200 may be installed proximate another section of track 114. For example, the section of track 215 of the at least partially assembled drive module 200 may be suspended from (i.e., hung from) an overhead support member 198 (see FIG. 3). The section of track 215 of the at least partially assembled drive module 200 may be at least substantially aligned with the proximate section of track 114 so that a movable partition 102 coupled to the track 114 may move freely between the section of track 215 of the drive module 200 and the proximate section of track 114.

Installing a movable partition system 100 in this manner may be advantageous by improving the ease and speed with which on-site installation occurs. By providing an at least partially assembled drive module 200 at the space to be partitioned, installation may simply involve lifting the at least partially assembled drive module 200 into place and securing it into the movable partition system 100. Conventionally, each individual component of a drive system is installed separately into a movable partition system, taking up time, effort, and cost at the installation site. Additionally, packaging and shipping costs may be saved by following the method of installing of this disclosure by packaging and shipping the drive module

200 as a unit, rather than by packaging and shipping components of the drive module 200 separately.

CONCLUSION

In some embodiments, the disclosure includes movable partition systems including a movable partition coupled to and movable along a track, a drive mechanism positioned at least partially on a side of the track opposite the movable partition, and an elongated drive member coupled to the movable partition extending along the track. The drive mechanism includes a motor for moving the movable partition along the track. The elongated drive member is configured to be driven by the motor. The drive mechanism may also, in some embodiments, include at least one of an electronic component for controlling the motor, a gearbox, and a clutch mechanism. A drive shaft of the motor may be oriented to rotate about a rotational axis at least substantially parallel with a longitudinal length of the track.

In additional embodiments, the disclosure includes automatically movable partition systems that include a movable partition coupled to and movable along a track, and a motor configured to drive the movable partition along the track. The motor is positioned on a side of the track opposite the movable partition. A drive shaft of the motor is oriented to rotate about a rotational axis at least substantially parallel to a longitudinal length of the track.

In yet further embodiments, the disclosure includes methods of installing a movable partition system. In accordance with such methods, a movable partition is coupled to a track, a drive mechanism is positioned at least partially on a side of the track opposite the movable partition, and an elongated drive member configured to be driven by the drive mechanism is coupled to the movable partition.

In additional embodiments, the disclosure includes methods of moving a movable partition along a track. In accordance with such methods, a drive mechanism positioned at least substantially in a header recess over a detachable section of track is actuated, a rotatable drive member is rotated with the drive mechanism, and a movable partition coupled to an elongated drive member engaged with the rotatable drive member is moved along the track.

In yet further embodiments, the disclosure includes a drive module for a movable partition system. The drive module includes a section of track with a longitudinally extending channel and a longitudinally extending opening on a first side thereof and a motor coupled to the section of track on a second side thereof opposite the first side. In some embodiments, the drive module includes at least one electronic component configured to control operation of the motor, the at least one electronic component also coupled to the section of track on the second side of the track.

In additional embodiments, the disclosure includes methods of installing a movable partition system. In accordance with such methods, a section of track is provided having at least one interior surface defining a longitudinally extending channel. The longitudinally extending channel is configured to receive and support at least one roller therein. The section of track also includes at least one surface defining a longitudinally extending opening to the longitudinally extending channel on a first side of the section of track. A motor is attached to the section of track on a second side thereof opposite the first side. The section of track is installed in a building after attaching the motor to the second side of the section of track. In some embodiments, the method may include attaching the motor to the second side of the section of track at a first location remote from the building and transporting the section of track with the motor attached thereto to the building.

While the invention may be susceptible to various modifications and alternative forms, specific embodiments have been shown by way of example in the drawings and have been described in detail herein. However, the invention is not intended to be limited to the particular forms disclosed. Rather, the invention includes all modifications, equivalents, combinations, and alternatives falling within the spirit and scope of the invention as defined by the following appended claims.

What is claimed is:

1. A movable partition system, comprising:
- a movable partition coupled to and movable along a track;
- a drive mechanism positioned directly above the track and on a side of a section of the track opposite the movable partition, the drive mechanism comprising:
  - a motor for moving the movable partition along the track;
  - an electronic component for controlling the motor;
  - a gearbox coupled with the motor; and
  - a clutch mechanism disposed between and coupled with each of the gearbox and a rotatable drive member; and
- an elongated drive member coupled to the movable partition extending along the track and configured to be driven by the motor.

2. The movable partition system of claim 1, wherein the motor is configured to drive rotation of the rotatable drive member engaged with the elongated drive member.

3. The movable partition system of claim 1, wherein the electronic component comprises one or more of a controller, a logic unit, a position sensor, and a charger.

4. The movable partition system of claim 1, wherein the drive mechanism is positioned entirely on the side of the section of the track opposite the movable partition.

5. The movable partition system of claim 1, wherein the drive mechanism is attached to the section of the track in a fixed position relative to the track.

6. The movable partition system of claim 1, further comprising at least one idler attached to a support structure and rotatable relative to the support structure, the at least one idler engaged with the elongated drive member.

7. The movable partition system of claim 1, wherein the motor comprises a drive shaft oriented to rotate about a rotational axis oriented at least substantially parallel to a longitudinal length of the track.

8. An automatically movable partition system, comprising:
- a movable partition coupled to and movable along a track;
- a motor configured to move the movable partition along the track, the motor positioned directly above the track and on a side of the track opposite the movable partition, the motor comprising a drive shaft configured and oriented to rotate about a rotational axis at least substantially parallel to a longitudinal length of the track;
- at least one electronic component for controlling movement of the movable partition;
- a gearbox operatively coupled with the drive shaft of the motor, the gearbox positioned directly above the track and on a side of the track opposite the movable partition, the and
- a clutch mechanism operatively coupled with the drive shaft of the motor, the clutch mechanism positioned directly above the track and on a side of the track opposite the movable partition.

9. The automatically movable partition system of claim 8, wherein the at least one electronic component is positioned directly above the track and on the side of the track opposite the movable partition.

10. The automatically movable partition system of claim 9, wherein the motor and the at least one electronic component are each coupled to a detachable section of the track.

11. The automatically movable partition system of claim 8, wherein:

the motor configured to move the movable partition comprises a motor configured to cause rotation of a rotatable drive member;

the rotatable drive member is engaged with an elongated drive member; and the elongated drive member is coupled to the movable partition such that movement of the elongated drive member causes movement of the movable partition.

12. The automatically movable partition system of claim 11, further comprising a drive trolley movably coupled to the track, wherein a leading end of the movable partition and the elongated drive member are fixedly attached to the drive trolley.

13. The automatically movable partition system of claim 8, wherein the movable partition comprises an accordion folding door.

14. A method of installing a movable partition system, comprising:

coupling a movable partition to a track such that the movable partition is movable along the track;

positioning a drive mechanism for moving the movable partition along the track directly above the track and on a side of the track opposite the movable partition, wherein the positioning a drive mechanism comprises positioning a motor, at least one electronic component, a gearbox, and a clutch mechanism directly above the track and on a side of the track opposite the movable partition; and coupling an elongated drive member configured to be driven by the drive mechanism to the movable partition.

15. The method of claim 14, further comprising mounting the drive mechanism to the track on the side of the track opposite the movable partition.

16. The method of claim 14, wherein positioning the drive mechanism for moving the movable partition along the track on the side of the track opposite the movable partition comprises positioning the drive mechanism over a detachable section of the track.

17. A method of moving a movable partition along a track, comprising:

actuating a drive mechanism positioned at least substantially in a header recess, directly above a detachable section of a track, and on a side of the track opposite a movable partition, wherein actuating the drive mechanism comprises:

causing an electronic component of the drive mechanism to activate a motor of the drive mechanism, the electronic component positioned at least substantially in the header recess;

engaging a gearbox of the drive mechanism with the motor, the gearbox disposed at least substantially in the header recess and coupled with the motor; and engaging a clutch mechanism of the drive mechanism with the gearbox, the clutch mechanism disposed at least substantially in the header recess between and coupled with each of the gearbox and a rotatable drive member;

rotating the rotatable drive member with the drive mechanism; and moving the movable partition coupled to an elongated drive member engaged with the rotatable drive member along the track.

18. A drive module for a movable partition system, the drive module comprising:

a section of track comprising at least one interior surface defining a longitudinally extending channel configured to receive and support at least one roller therein, the section of track further comprising at least one surface defining a longitudinally extending opening to the longitudinally extending channel, the longitudinally extending opening to the longitudinally extending channel located on a first side of the section of track;

a motor coupled to the section of track on a second side of the track opposite the first side of the track and configured to be installed directly above the first side of the track;

at least one electronic component configured to control operation of the motor, the at least one electronic component coupled to the section of track on the second side of the track;

a gearbox operatively coupled with the motor; and a clutch mechanism operatively coupled with the gearbox.

19. The drive module of claim 18, wherein the motor comprises a drive shaft oriented and configured to rotate about a rotational axis parallel with a longitudinal length of the section of track.

20. The drive module of claim 18, wherein the motor is directly coupled to a support structure, and the support structure is directly coupled to the section of track.

21. The drive module of claim 18, further comprising at least one idler coupled to the section of track, the at least one idler rotatable relative to the section of track.

22. A method of installing a movable partition system, the method comprising:

providing a section of track comprising at least one interior surface defining a longitudinally extending channel configured to receive and support at least one roller therein, the section of track further comprising at least one surface defining a longitudinally extending opening to the longitudinally extending channel, the longitudinally extending opening to the longitudinally extending channel located on a first side of the section of track;

attaching a motor to a second side of the section of track opposite the first side of the section of track;

attaching at least one electronic component to the second side of the section of track;

coupling at least one of a gearbox and a clutch mechanism to the motor; and installing the section of track in a building after attaching the motor to the second side of the section of track, such that the motor, electronic component, and the at least one of the gearbox and the clutch mechanism are each positioned directly above the section of track.

23. The method of claim 22, further comprising attaching the motor to the second side of the section of track at a first location remote from the building, and subsequently transporting the section of the track with the motor attached thereto to the building prior to installing the section of the track in the building with the motor attached to the second side of the section of track.

24. The method of claim 22, wherein attaching the motor to the second side of the section of track comprises orienting a drive shaft of the motor to rotate about a rotational axis at least substantially parallel to a longitudinal length of the section of track.

25. The method of claim 22, wherein installing the section of track in the building comprises hanging the section of track from an overhead support member.

* * * * *

UNITED STATES PATENT AND TRADEMARK OFFICE

CERTIFICATE OF CORRECTION

PATENT NO. : 8,534,341 B2
APPLICATION NO. : 13/169584
DATED : September 17, 2013
INVENTOR(S) : W. Michael Coleman et al.

It is certified that error appears in the above-identified patent and that said Letters Patent is hereby corrected as shown below:

On the title page and in the specification:

In ITEM (54) and
COLUMN 1, LINE 2, Title:
2nd line — change "METHODS IF" to --METHODS OF--

In the claims:

CLAIM 8, COLUMN 14, LINE 62, change "partition," to --partition;--
CLAIM 8, COLUMN 14, LINE 63, change "the and" to --and--

Signed and Sealed this
Thirteenth Day of January, 2015

Michelle K. Lee

Michelle K. Lee
*Deputy Director of the United States Patent and Trademark Office*